US011535485B2

(12) United States Patent
Viita-aho et al.

(10) Patent No.: US 11,535,485 B2
(45) Date of Patent: Dec. 27, 2022

(54) METHOD FOR CONTROLLING AN ELEVATOR

(71) Applicant: KONE Corporation, Helsinki (FI)

(72) Inventors: Tarvo Viita-aho, Helsinki (FI); Tapani Talonen, Helsinki (FI); Janne Mikkonen, Helsinki (FI); Tapio Siironen, Helsinki (FI); Ville Myyryläinen, Helsinki (FI); Alessio Calcagno, Helsinki (FI); Markku Jokinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 504 days.

(21) Appl. No.: 16/784,013

(22) Filed: Feb. 6, 2020

(65) Prior Publication Data

US 2020/0283259 A1 Sep. 10, 2020

(30) Foreign Application Priority Data

Mar. 5, 2019 (EP) ..... 19160769

(51) Int. Cl.
*G10H 1/34* (2006.01)
*B66B 1/28* (2006.01)
(Continued)

(52) U.S. Cl.
CPC ..... *B66B 1/28* (2013.01); *B66B 1/3476* (2013.01); *B66B 5/0031* (2013.01); *B66B 5/02* (2013.01); *B66B 9/00* (2013.01)

(58) Field of Classification Search
CPC ... B66B 11/008; B66B 11/0045; B66B 11/08; B66B 11/04; B66B 5/18; B66B 11/0206;
(Continued)

(56) References Cited

U.S. PATENT DOCUMENTS

| | | | | |
|---|---|---|---|---|
| 5,156,239 | A | 10/1992 | Ericson et al. | |
| 9,051,154 | B2 | 6/2015 | Fischer et al. | |
| 2020/0283259 | A1 * | 9/2020 | Viita-Aho | B66B 9/00 |

FOREIGN PATENT DOCUMENTS

| | | | | |
|---|---|---|---|---|
| DE | 10348151 | A1 * | 5/2005 | B66B 11/00 |
| EP | 2746207 | A1 * | 6/2014 | B66B 1/3484 |

(Continued)

OTHER PUBLICATIONS

European Search Report for EP 19160769.6 dated Sep. 24, 2019.

*Primary Examiner* — Marlon T Fletcher
(74) *Attorney, Agent, or Firm* — Birch, Stewart, Kolasch & Birch, LLP

(57) ABSTRACT

The method includes loading and/or unloading the car, determining whether the car doors are fully closed or not fully open, measuring a total actual axial mass FΣact hanging from the traction sheave, determining a stalling limit total minimum axial mass FΣmin, checking reopening of the car doors, whereby if the car doors are reopened, then return to beginning, else, continue, permitting starting of elevator, comparing the total actual axial mass with the stalling limit total minimum axial mass, whereby if the total actual axial mass is equal to or greater than the stalling limit total minimum axial mass, then permit normal run of the elevator car to the next landing, else, stop the elevator.

20 Claims, 7 Drawing Sheets

Figure 1:
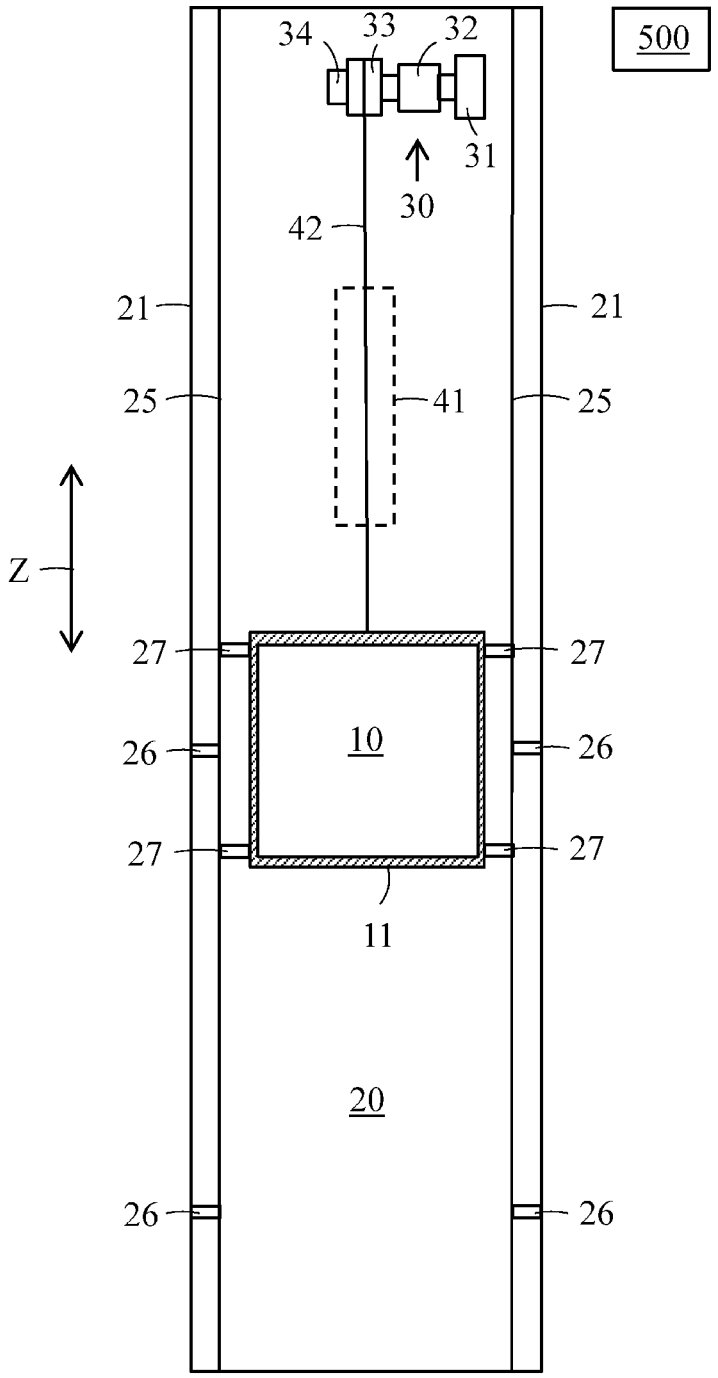

(51) Int. Cl.

| | |
|---|---|
| ***B66B 1/34*** | (2006.01) |
| ***B66B 5/00*** | (2006.01) |
| ***B66B 5/02*** | (2006.01) |
| ***B66B 9/00*** | (2006.01) |

(58) Field of Classification Search

CPC ..... B66B 11/0438; B66B 7/02; B66B 11/007; B66B 5/0006; B66B 5/0018; B66B 1/3476; B66B 15/04; B66B 1/36; B66B 13/16; B66B 13/26; B66B 15/02; B66B 15/08; B66B 1/44; B66B 11/001; B66B 11/0055; B66B 17/14; B66B 5/16; B66B 9/0807; B66B 13/00; B66B 13/10; B66B 5/24; B66B 5/284; B66B 7/04; B66B 1/34; B66B 9/0846

See application file for complete search history.

(56) References Cited

FOREIGN PATENT DOCUMENTS

| | | | | | |
|---|---|---|---|---|---|
| EP | 3705435 | A1 | * | 9/2020 | ..... B66B 1/3484 |
| EP | 3705441 | A1 | * | 9/2020 | ..... B66B 1/28 |
| FR | 124119 | B | * | 12/2012 | |
| WO | WO-2007116587 | A1 | * | 10/2007 | ..... B66B 11/008 |
| WO | WO 2008/071301 | A1 | | 6/2008 | |
| WO | WO 2013/045581 | A1 | | 4/2013 | |
| WO | WO 2015/072973 | A1 | | 5/2015 | |
| WO | WO-2015072973 | A1 | * | 5/2015 | ..... B66B 1/3476 |
| WO | WO-2016177794 | A1 | * | 11/2016 | ..... B66B 11/043 |

* cited by examiner

METHOD FOR CONTROLLING AN ELEVATOR

FIELD

The invention relates to a method for controlling an elevator.

BACKGROUND

An elevator may comprise a car, a shaft, hoisting machinery, ropes, and a counterweight. A separate or an integrated car frame may surround the car.

The hoisting machinery may be positioned in the shaft. The hoisting machinery may comprise a drive, an electric motor, a traction sheave, and a machinery brake. The hoisting machinery may move the car upwards and downwards in the shaft. The machinery brake may stop the rotation of the traction sheave and thereby the movement of the elevator car.

The car frame may be connected by the ropes via the traction sheave to the counterweight. The car frame may further be supported with gliding means at guide rails extending in the vertical direction in the shaft. The guide rails may be attached with fastening brackets to the side wall structures in the shaft. The gliding means keep the car in position in the horizontal plane when the car moves upwards and downwards in the shaft. The counterweight may be supported in a corresponding way on guide rails that are attached to the wall structure of the shaft.

The car may transport people and/or goods between the landings in the building. The shaft may be formed so that the wall structure is formed of solid walls or so that the wall structure is formed of an open steel structure.

The elevator may be controlled by a controller.

SUMMARY

An object of the present invention is an improved method for controlling an elevator.

The method for controlling the elevator according to the invention is defined in claim 1.

The elevator comprises a car, a shaft, a hoisting machinery with a traction sheave, hoisting ropes, a counterweight, and a controller, the hoisting ropes passing over the traction sheave so that the car is suspended with the hoisting ropes on a first side of the traction sheave and the counterweight is suspended with the hoisting ropes on a second opposite side of the traction sheave, the car moving upwards and downwards between landings in the elevator shaft.

The method comprises a first step in which the car (10) is on a landing with car doors open for loading and/or unloading the car (10), a second step in which it is determined whether the car doors are fully closed or the car doors are not fully open after the loading and/or unloading is completed, a third step in which the total actual axial mass FΣact hanging from the traction sheave (33) is measured, a fourth step in which a stalling limit total minimum axial mass FΣmin hanging from the traction sheave (33) is determined, a fifth step in which reopening of the car (10) doors is checked, whereby if the car (10) doors are reopened, then return to the first step, else, continue to the next step, a sixth step in which start of the elevator is permitted, an seventh step in which the total actual axial mass FΣact measured in the third step is compared with the stalling limit total minimum axial mass FΣmin determined in the fourth step, whereby if the total actual axial mass FΣact measured in the third step is equal to or greater than the stalling limit total minimum axial mass FΣmin determined in the fourth step, then normal run of the elevator car (10) to the next landing is permitted, else, the elevator is stopped.

The method for controlling the elevator may use the same Load Weighing Device (LWD) sensors and interfaces which can be used also for overload detection and drive starting torque (balance) setting. There is thus no need for additional switches in terminals or rope & tension weight switch systems.

LWD sensors positioned in connection with the bedplate of the hoisting machinery may measure the total masses acting on the bedplate. The masses hanging from the car side and the counterweight (CWT) side of the traction sheave may be determined based on the measurements. This means that stalling of the car and the CWT can be detected with the same system and sensors used for overload detection and drive starting torque (balance) setting.

The method can be applied in an elevator with any suspension ratio, e.g. a 2:1 suspension ratio or a 1:1 suspension ratio due to the fact that the method is based on traction sheave axial hanging masses.

In the method, the weight of the hoisting ropes on the car side and on the CWT side of the traction sheave are measured, which means that hoisting rope compensation factors are not needed in the method. Only travelling cable compensation factors may be needed in the method.

The measurement of the total masses acting on bedplate of the hoisting machinery may be done continuously or only when needed.

A continuous measurement of the masses acting on the bedplate of the hoisting machinery makes it possible also to determine acceleration, deceleration and constant speed of the car.

DRAWINGS

Figure 2:
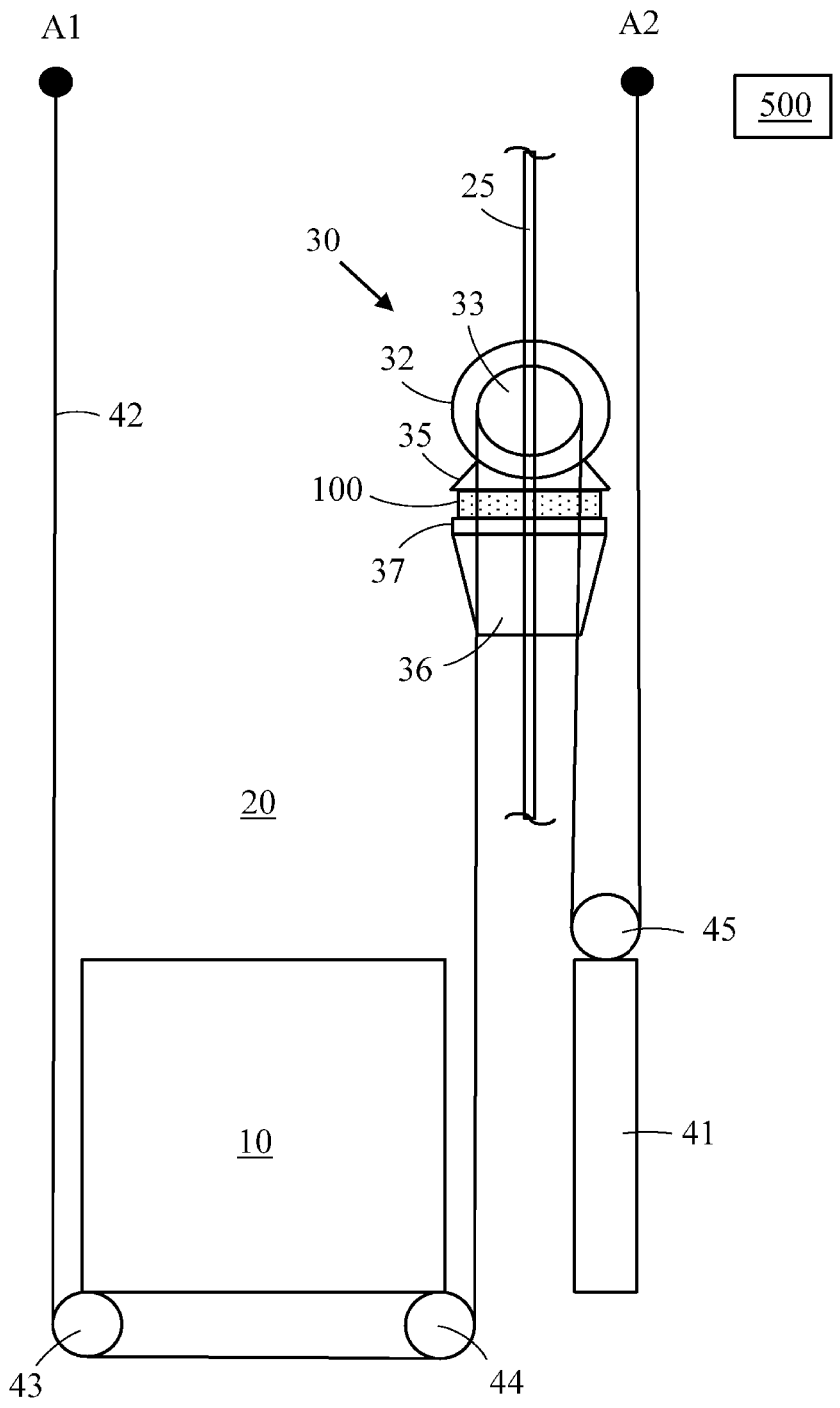
Figure 3:
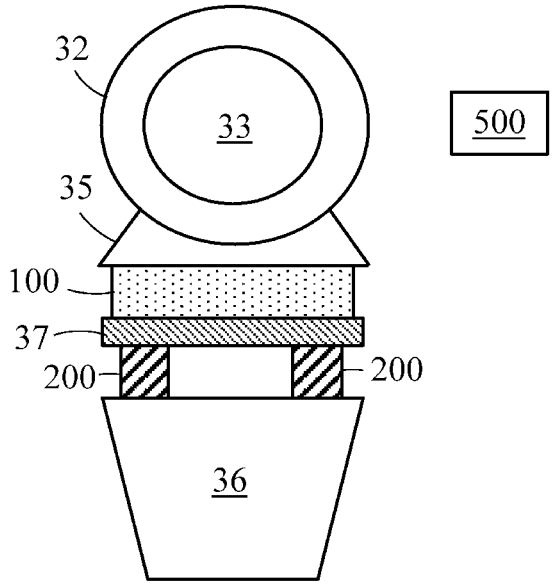
Figure 4:
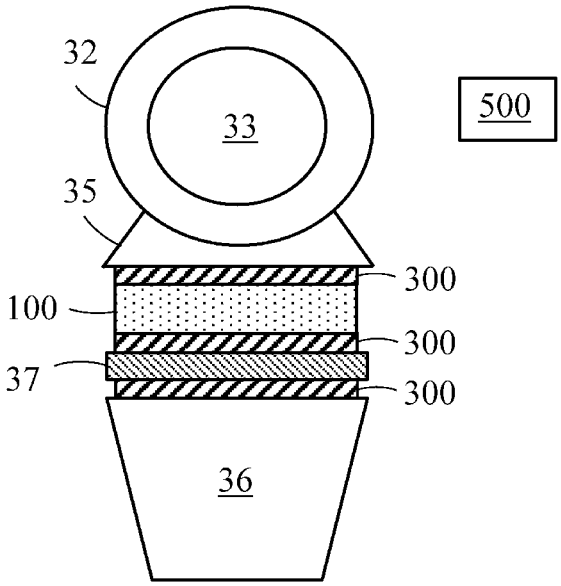
Figure 5:
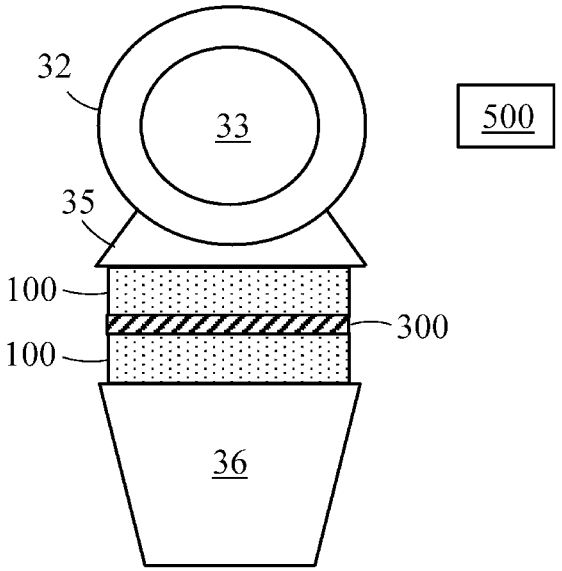
Figure 6:
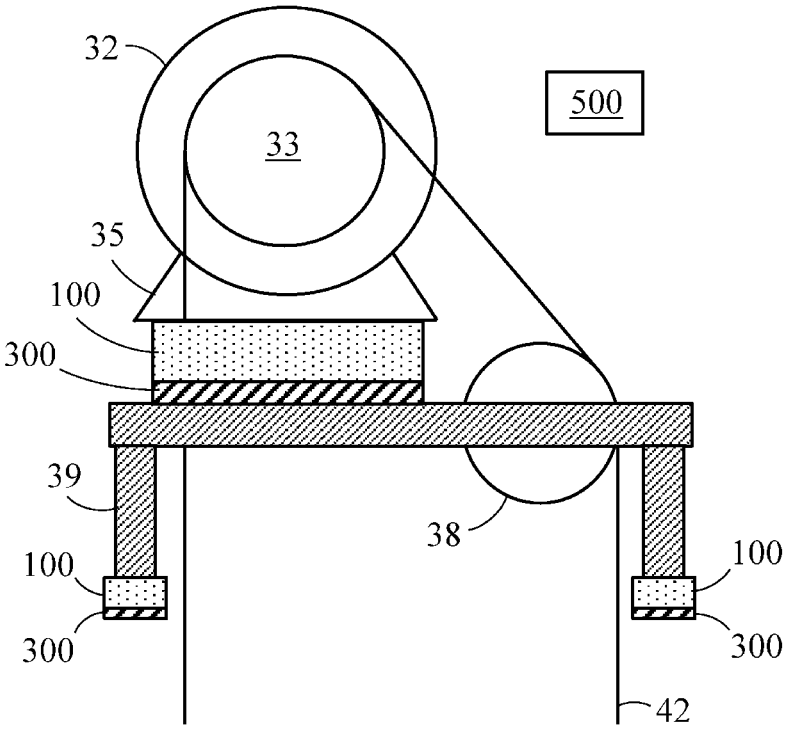
Figure 7:
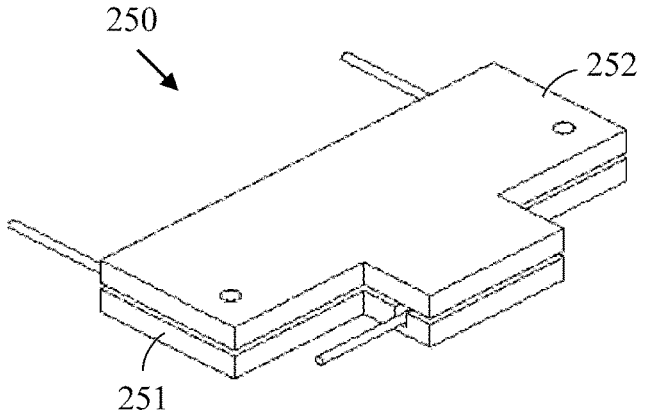
Figure 8:
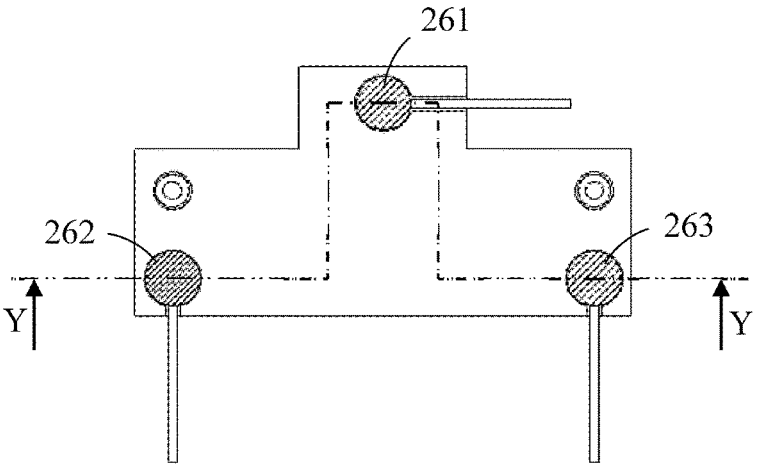
Figure 9:
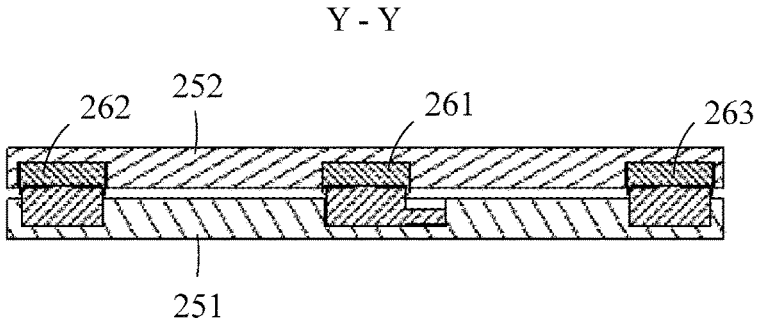
Figure 10:
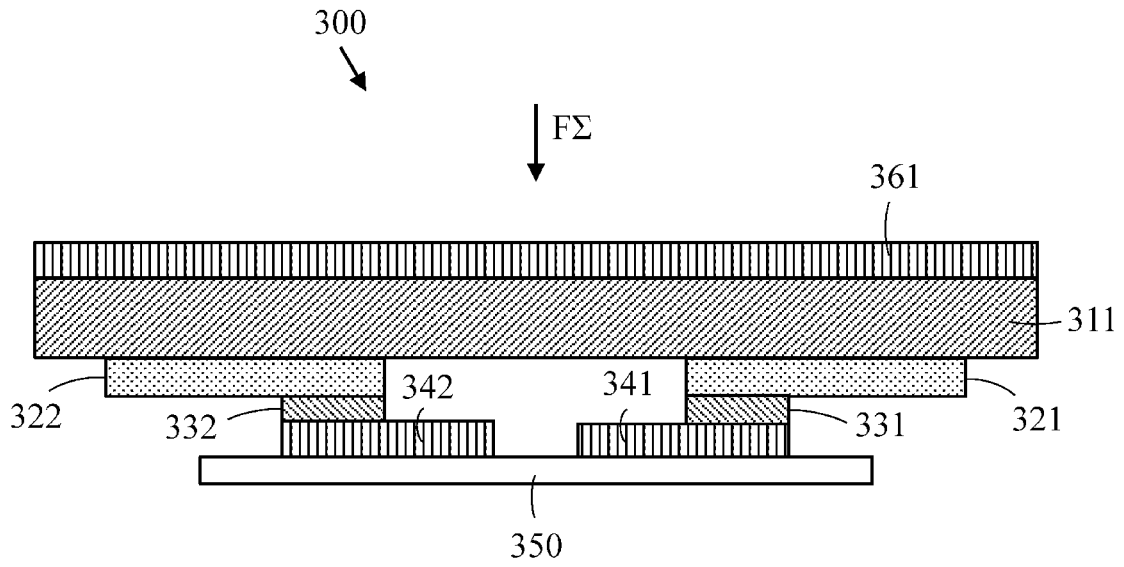
Figure 11:
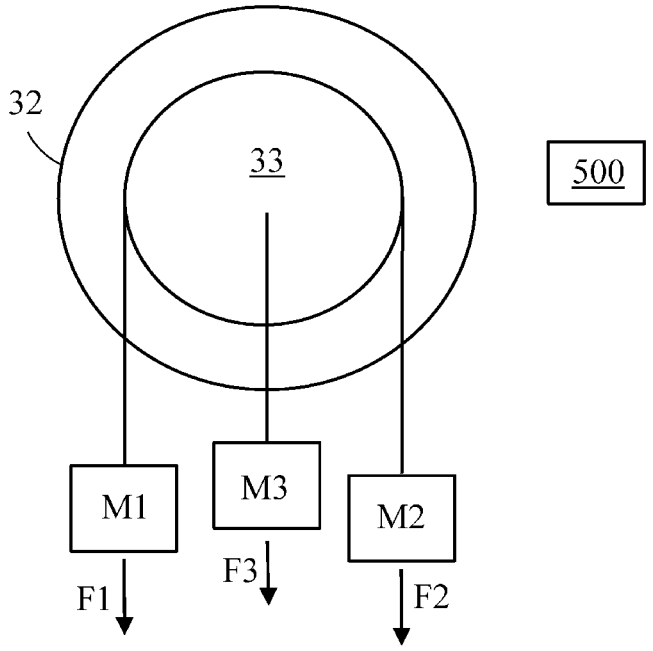
Figure 12:
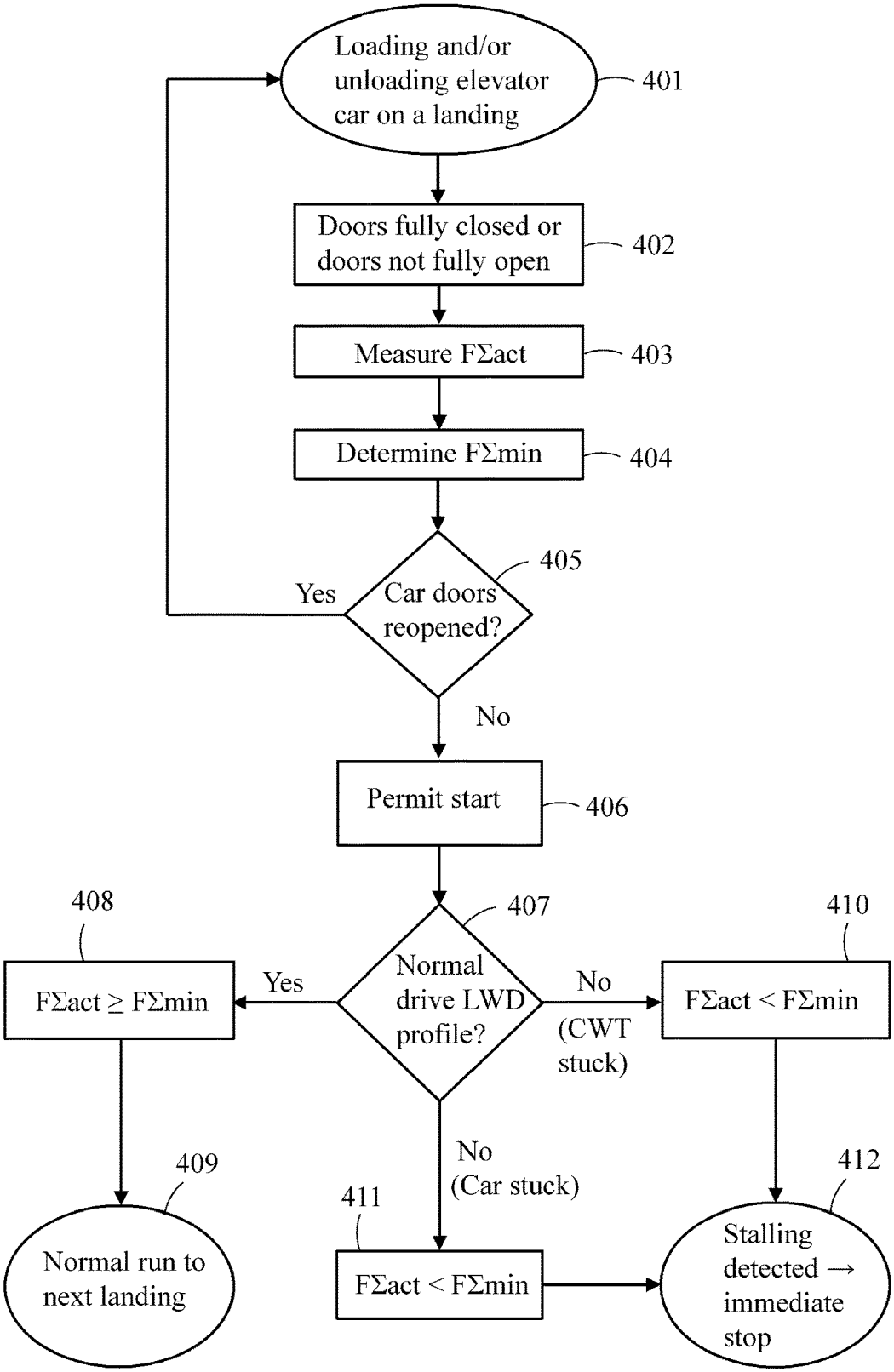

The invention will in the following be described in greater detail by means of preferred embodiments with reference to the attached drawings, in which FIG. 1 shows a side view of a first elevator, FIG. 2 shows a side view of a second elevator, FIG. 3 shows a side view of a first support arrangement of the elevator machinery, FIG. 4 shows a side view of a second support arrangement of the elevator machinery, FIG. 5 shows a side view of a third support arrangement of the elevator machinery, FIG. 6 shows a side view of a fourth support arrangement of the elevator machinery, FIG. 7 shows an axonometric view of a sensor, FIG. 8 shows a plan view of the sensor, FIG. 9 shows a cross sectional view of the sensor, FIG. 10 shows a further sensor, FIG. 11 shows forces acting on the traction sheave in an elevator, FIG. 12 shows a flow diagram of a method for controlling an elevator.

DETAILED DESCRIPTION

FIG. 1 shows a side view of a first elevator.

The elevator may comprise a car 10, an elevator shaft 20, hoisting machinery 30, hoisting ropes 42, and a counterweight 41. A separate or an integrated car frame 11 may surround the car 10.

The hoisting machinery 30 may be positioned in the shaft 20. The hoisting machinery may comprise a drive 31, an electric motor 32, a traction sheave 33, and a machinery brake 34. The hoisting machinery 30 may move the car 10 in a vertical direction Z upwards and downwards in the vertically extending elevator shaft 20. The machinery brake 34 may stop the rotation of the traction sheave 33 and thereby the movement of the elevator car 10.

The car frame 11 may be connected by the ropes 42 via the traction sheave 33 to the counterweight 41. The car frame 11 may further be supported with gliding means 27 at guide rails 25 extending in the vertical direction in the shaft 20. The gliding means 27 may comprise rolls rolling on the guide rails 25 or gliding shoes gliding on the guide rails 25 when the car 10 is moving upwards and downwards in the elevator shaft 20. The guide rails 25 may be attached with fastening brackets 26 to the side wall structures 21 in the elevator shaft 20. The gliding means 27 keep the car 10 in position in the horizontal plane when the car 10 moves upwards and downwards in the elevator shaft 20. The counterweight 41 may be supported in a corresponding way on guide rails that are attached to the wall structure 21 of the shaft 20.

The car 10 may transport people and/or goods between the landings in the building. The elevator shaft 20 may be formed so that the wall structure 21 is formed of solid walls or so that the wall structure 21 is formed of an open steel structure.

The suspension ratio is 1:1 in this first elevator. When the electric motor 32 lifts or lowers the car 10 in this first elevator by X meters, then X meters of lifting rope 42 passes over the traction sheave 32.

The elevator may be controlled by a controller 500.

FIG. 2 shows a side view of a second elevator.

The suspension ratio in this second elevator is 2:1 compared to the suspension ratio 1:1 in the first elevator shown in FIG. 1. When the electric motor 32 lifts or lowers the car 10 in this second elevator by X meters, then 2X meters of lifting rope 42 passes over the traction sheave 32.

Both ends of the hoisting rope 42 are fixed in fixing points A1, A2 to the shaft 20 in an upper end portion of the shaft 20. The hoisting rope 42 passes from a first fixing point A1 vertically downwards in the shaft 20 towards the lower end of the car 10. The hoisting rope 42 is then turned on a first deflection roll 43 positioned below the car 10 into a horizontal direction. The hoisting rope 42 passes then in the horizontal direction to a second deflection roll 44 positioned below the car 10 at an opposite side of the car 10 in relation to the first deflection roll 43. The car 10 is supported on the first deflection roll 43 and on the second deflection roll 44. The hoisting rope 42 passes after the second deflection roll 44 again vertically upwards in the shaft 20 towards the traction sheave 33. The hoisting rope 42 is then again turned on the traction sheave 33 into a vertically downwards directed direction in the shaft 20 towards a third deflection roll 45. The counterweight 41 is supported on the third deflection roll 45. The hoisting rope 42 passes then after the third deflection roll 45 again vertically upwards in the shaft 20 to the second fixing point A2. Rotation of the traction sheave 33 in a clockwise direction moves the car 10 upwards, whereby the counterweight 41 moves downwards and vice a versa. The friction between the hoisting rope 42 and the traction sheave 33 eliminates slipping of the hoisting rope 42 on the traction sheave 33 in normal operational conditions.

The electric motor 32 in the hoisting machinery 30 may comprise a motor frame 35 for supporting the hoisting machinery 30 at a motor bed frame 36. An isolation pad 100 and a load transfer plate 37 may be positioned between the motor frame 35 and the motor bed 36. The motor bed 36 may be supported on a guide rail 25 in the shaft 20. The hoisting machinery 30 could be supported on the guide rail 25 in any height position along the guide rail 25. The traction sheave 33 and the electric motor 32 could also be separated. The traction sheave 33 could be supported on the guide rail 25 in the shaft 20 and the electric motor 32 could be positioned e.g. at the bottom of the pit in the shaft 20. A power transmission would thus be needed between the traction sheave 33 and the electric motor 32.

The elevator may be controlled by a controller 500.

FIG. 3 shows a side view of a first support arrangement of the elevator machinery.

The support arrangement between the motor frame 35 of the hoisting machinery 30 and the motor bed 36 may comprise the isolation pad 100, the load transfer plate 37 and at least one sensor 200 for measuring continuously the forces acting on the traction sheave 33.

The sensor(s) 200 may be positioned between the load transfer plate 37 and the motor bed 36. Another possibility is to position the sensor(s) 200 in connection with the shaft of the traction sheave 33. The sensors could in the latter situation be positioned in connection with the bearing of the shaft of the traction sheave 33, whereby the sensors 200 would measure the force acting on the shaft of the traction sheave 33.

Any sensors 200 capable of measuring continuously the forces acting on the traction sheave 33 may be used.

The sensor may be formed of a load cell i.e. a transducer which converts force into a measurable electric output. Strain gauge load cells, which are the most common in industry, could be used in this first support arrangement. Strain gauge load cells are particularly stiff, have very good resonance values, and tend to have long life cycles in application. Strain gauge load cells work on the principle that the strain gauge (a planar resistor) deform when the material of the load cells deforms appropriately. Deformation of the strain gauge changes its electrical resistance, by an amount that is proportional to the strain. The change in the resistance of the strain gauge provides an electric value change that is calibrated to the load placed on the load cell. A load cell usually consists of four strain gauges in a Wheatstone bridge configuration. Also piezoelectric load cells, hydraulic load cells, pneumatic load cells could be used in this first support arrangement.

The elevator may be controlled by a controller 500.

FIG. 4 shows a side view of a second support arrangement of the elevator machinery.

The difference between this second support arrangement and the first support arrangement is in the sensor 300 that is used.

The sensor 300 may be positioned between the frame support and the isolation pad 100 or between the isolation pad 100 and the load transfer plate 37 or between the load transfer plate 37 and the frame structure 36.

The elevator may be controlled by a controller 500.

FIG. 5 shows a side view of a third support arrangement of the elevator machinery.

The sensor 300 may be positioned between two vibration isolation pads 100, two vibration isolation pads 100 being positioned between the motor frame 35 and the motor bed 36.

The elevator may be controlled by a controller 500.

FIG. 6 shows a side view of a fourth support arrangement of the elevator machinery.

The sensor 300 may be positioned between the vibration isolation pad 100 and the motor bed 39 or between the lower ends of the legs of the motor bed 39 and the floor of the machine room.

FIG. 7 shows an axonometric view, FIG. 8 shows a plan view and FIG. 9 shows a cross sectional view of a sensor.

The sensor is a strain gauge sensor 250. Three sensor assemblies 261, 262, 263 are embedded between a bottom plate 251 and a top plate 252. The second sensor 250 may be positioned between two planar surfaces e.g. between the machinery and the bed plate.

A strain gauge load cell is particularly stiff, has a very good resonance value, and tend to have a long life cycle in application. The strain gauge load cell work on the principle that the strain gauge (a planar resistor) deform when the material of the load cells deforms appropriately. Deformation of the strain gauge changes its electrical resistance, by an amount that is proportional to the strain. The change in the resistance of the strain gauge provides an electric value change that is calibrated to the load placed on the load cell.

FIG. 10 shows a further sensor.

The further sensor may be formed of a capacitive sensor. The capacitive sensor may be formed of an electrically non-conducting first layer. The first layer may be elastic i.e. it returns to its original shape when unloaded. The first layer should thus be reversibly compressible. At least one electrically conductive electrode may be provided at a first surface of the first layer. An electrically conductive layer may be provided on the second opposite surface of the first layer. A pressure on the first material layer caused by a weight will cause compression of the first layer, whereby the distance between the at least one electrically conductive electrode and the electrically conductive layer will change. The change in the distance will change the capacitance between the at least one electrode and the electrically conductive layer. The weight acting on the first layer is thus proportional to the change in the capacitance between the at least one electrode and the electrically conductive layer.

The sensor 300 may comprise a first layer 311. The first layer 311 may be an elastic and stretchable layer of an electrically non-conducting material. The first layer 311 may be formed as one single layer or as two or more different layers. At least two stretchable electrodes 321, 322 may be provided on a first surface of the first layer 311. The electrodes 321, 322 may be attached form a first surface to the first surface of the first layer 311 so that the electrodes 321, 322 are positioned at a distance apart from each other. A flexible foil 350 may further be provided. An electrically conductive wiring 341, 342 may be connected to the flexible foil 350 and via connections 331, 332 to the electrodes 321, 322. The electrically conductive wiring 341, 342 may be attached to a second surface of the electrodes 321, 322. The second surface of the electrodes 321, 322 is opposite to the first surface of the electrodes 321, 322. An electrically conducting layer 361 may further be provided on a second surface of the first layer 311. The second surface of the first layer 311 is opposite to the first surface of the first layer 311.

The sensor 300 may form a capacitive sensor, whereby the capacitance between each electrode 321, 322 and the electrically conductive layer 361 may be measured. The distance between the electrodes 321, 322 and the electrically conductive layer 361 varies is response to the force F acting on the sensor 300.

The first layer has a first Young's modulus Y311 and a first yield strain ε311. The first yield stain ε311 is at least 10 percent.

Young's modulus is a mechanical property that measures the stiffness of a solid material. It defines the relationship between stress (force per unit area) and strain (proportional deformation) in a material in the linear elasticity regime of a uniaxial deformation.

The yield point is the point on a stress-strain curve that indicates the limit of elastic behavior and the beginning of plastic behavior. Yield strength or yield stress is a material property defining the stress at which a material begins to deform plastically whereas yield point is the point where nonlinear (elastic+plastic) deformation begins. Prior to the yield point the material will deform elastically and will return to its original shape when the applied stress is removed. Once the yield point is passed, some fraction of the deformation will be permanent and non-reversible. Yield strain is a strain value corresponding to yield stress. The yield strain can be read from a material's stress-strain curve for yield point. The yield strain defines the material's elongation limit before plastic deformation occurs.

The first layer 311 may comprise at least one of polyurethane, polyethylene, poly(ethylene-vinyl acetate), polyvinyl chloride, polyborodimethylsiloxane, polystyrene, acrylonitrile-butadiene-styrene, styrene-butadienestyrene, ethylene propylene rubber, neoprene, cork, latex, natural rubber, silicone and thermoplastic gel.

The stretchable electrodes 321, 322 may comprise electrically conductive particles, such as flakes or nanoparticles, attached to each other in an electrically conductive manner. The electrical conductive particles may comprise at least one of carbon copper, silver and gold.

The electrically conductive layer 361 may comprise at least one of electrically conductive material from conductive ink, electrically conductive fabric and electrically conductive polymer.

The connection 331, 332 may be made from electrically conductive adhesive, i.e. an adhesive comprising cured electrically conductive adhesive. Such adhesives include isotropically conductive adhesives and anisotropically conductive adhesives.

The flexible foil 350 has a second Young's modulus Y350. The first Young's modulus Y311 is smaller than the second Young's modulus Y350.

The flexible foil 350 may comprise at least one of polyester, polyamide, polyethylene, naphthalate, and polyetheretherketone.

The second sensor 300 may measure the force acting on the machine bed.

An electrically conductive material means in this application a material of which the resistivity (specific electric resistivity) is less than 1 Ωm at the temperature of 20 degrees Celsius. An electrically non-conductive material means in this application a material of which the resistivity (specific electric resistivity) is more than 100 Ωm at the temperature of 20 degrees Celsius.

FIG. 11 shows forces acting on the traction sheave in an elevator.

The figure shows masses M1 and M2 hanging from each side of the traction sheave 33 and a mass M3 of the hoisting machinery 30. The masses M1, M2, M3 cause corresponding forces F1, F2, F3 acting on the machinery bedplate of the hoisting machinery 30. The first force F1 is caused by the masses M1 hanging with the hoisting ropes 42 on the first side of the traction sheave 33. The masses M1 hanging on the first side of the traction sheave 33 is formed of at least the car 10 and the load Q in the car 10. The second force F2 is caused by the masses M2 hanging with the hoisting ropes 42 on the second opposite side of the traction sheave 33. The masses M2 hanging on the second side of the traction sheave 33 is formed of at least the counterweight 41. The third force F3 is caused by the masses M3 of the hoisting machinery 30 acting on the machinery bed plate. The total force F1 acting on the machinery bedplate hanging from the traction sheave 33 is formed of the sum of the forces F1, F2 and F3 i.e. FΣ=F1+F2+F3.

The total force FΣ acting on the machinery bedplate may be measured with the sensor(s) arrangements disclosed in FIGS. 3-10.

The elevator may be controlled by a controller 500.

The situation is exemplified with the following example. The starting point in the example is a 50% balancing ratio in an elevator with a 2:1 suspension ratio. The car weight KT is 600 kg, the weight of the maximum load in the car is $Q_{max}$=1000 kg. The weight of the counterweight (CWT) is thus KT+0.5 $Q_{max}$=600+0.5*1000 kg=1100 kg.

The total minimum axial hanging mass with an empty car 10 may be calculated in the following way in an elevator with a 2:1 suspension ratio:

$$F1=KT/2=600/2=300 \text{ kg}$$

$$F2=\text{CWT}/2=(KT+0.5*Q_{max})/2=(600+0.5*1000)/2=550 \text{ kg}$$

The total minimum axial hanging mass with an empty car 10 is thus the sum of the masses F1 and F2 i.e. 300+550=850 kg.

The total actual axial hanging mass with a full car 10 may be calculated in the following way in an elevator with a 2:1 suspension ratio:

$$F1=(KT+Q_{max})/2=(600+1000)/2=800 \text{ kg}$$

$$F2=\text{CWT}/2=(KT+0.5*Q_{max})/2=(600+0.5*1000)/2=550 \text{ kg}$$

The total actual axial hanging mass with a full car 10 is thus the sum of the masses F1+F2 i.e. 800+550=1350 kg Three different stalling situations may occur:

CWT stalling (F2=0) with empty car. The total actual axial hanging mass is thus F1=300 kg, which is smaller than the total minimum axial hanging mass 850 kg with an empty car. Stalling detection is activated and the elevator motor is stopped.

CWT stalling (F2=0) with full car. The total actual axial hanging mass is F1=800 kg, which is smaller than the total minimum axial hanging mass 1350 kg with a full car. Stalling detection is activated and the elevator motor is stopped.

Car stalling (F1=0). The total actual axial hanging mass is F2=550 kg, which is smaller than the total minimum axial hanging mass 850 kg. Stalling detection is activated and the elevator motor is stopped.

In order to improve the reliability and in order to enable stalling detection also with a smaller balancing percentage and/or in an overload (e.g. 110% load) situation (when the total actual axial hanging mass KT+$Q_{act}$ is greater than the allowed total minimum axial hanging mass), a predetermined stalling limit weight reduction tolerance may be used in the stalling detection activation. The predetermined stalling limit weight should be divided by the elevator suspension ratio SPR. The weight KT of the car may be used as one possible stalling limit weight reduction tolerance. The stalling limit weight reduction tolerance in an elevator with a 2:1 suspension ratio would thus be KT/2. The stalling detection may be activated:

1. when the elevator car doors are fully closed or the car doors are not fully open,
2. the elevator has started and the elevator motor is running,
3. the brakes are opened.

In this case, the elevator stalling detection can determine a total minimum axial hanging mass FΣmin after the car doors have been closed but before the actual start of the elevator based on the total actual axial hanging mass FΣact.

This makes it possible to use axial force LWD based stalling detection also for CWT stalling i.e. there is no need e.g. for stalling detection switches on the CWT side of the suspension terminal.

FIG. 11 shows a flow diagram of a method for controlling an elevator.

The elevator car 10 is first loaded and/or unloaded on a landing in step 401.

The car 10 doors are fully closed or the car doors are not fully open i.e. the loading and/or the unloading of the car 10 has been completed in step 402.

The total actual axial hanging mass FΣact is measured in step 403. The total actual axial hanging mass FΣact may be measured by one or more load sensors. The total actual axial hanging mass FΣact=(F1act+F2+F3)/SPR=[(KT+Qact)+(KT+Bal %*Qmax)+F3(Machinery)]/SPR. SPR is the suspension ratio of the elevator i.e. 2 in case the suspension ratio of the elevator is 2:1.

A total minimum axial hanging mass FΣmin is then determined for the elevator in step 404. The total minimum axial hanging mass FΣmin may be determined by deducting a stalling weight reduction tolerance (a tolerance weight) divided by the elevator suspension ratio SPR. The weight KT of the car is one possible reduced stalling weight when determining the total minimum axial hanging mass FΣmin=FΣact−KT/SPR. The total minimum axial hanging mass FΣmin may in an elevator with a 1:1 suspension ratio be determined as FΣmin=FΣact−KT and in an elevator with a 2:1 suspension ration be determined as FΣmin=FΣact−KT/2.

A possible reopening of the car 10 doors is then detected in step 405. The car 10 doors may be reopened e.g. in case the load in the car 10 exceeds the maximum load. The car 10 doors may also be reopened e.g. in case somebody presses the call button on the landing when the car doors are closing or the car doors have closed, but the car has not yet started.

I the answer is yes i.e. the car 10 doors are reopened, then the method starts again from the beginning.

If the answer is no i.e. the car 10 doors are not reopened, then start of the elevator is permitted in step 406. The start of the elevator may be permitted e.g. by permitting opening of the machinery brake. The car may also be kept in place by the machinery, whereby start of the elevator may be permitted by permitting drive of the machinery.

Then it is determined whether the elevator operates in a normal drive LWD (Load Weighing Device) profile in step 407. The normal drive LWD profile is based on the determined total minimum axial hanging mass FΣmin i.e. the stalling limit.

The answer is yes, i.e. the elevator is operating in the normal drive LWD profile, when the total actual axial hanging mass FΣact is equal to or greater than the determined stalling limit total minimum axial hanging mass FΣmin in step 408.

The elevator car 10 may now be moved in a normal run to the next landing in step 409.

The answer is no, i.e. the elevator is not operating within the normal drive LWD profile, when the total actual axial hanging mass FΣact is smaller than the stalling limit total minimum axial hanging mass FΣmin. The counterweight 41 is stuck when F2=0 in step 410. The car 10 is stuck when F1=0 in step 411.

The answer is thus no when the counterweight 41 is stuck or the car 10 is stuck, whereby stalling is detected and the hoisting machinery is immediately stopped 412.

The analytics that process the measurement results may be able to determine which of the two i.e. the counterweight 41 or the car 10 is stalling. This may be done based on the forces acting on each side of the traction sheave 33. The moment acting on the shaft of the traction sheave 33 will change when the forces acting on each side of the traction sheave 33 changes. Several sensors or a sensor with several pressure cells may be needed in order to be able to measure forces on each side of the traction sheave 33.

The term force and weight are used more or less as synonyms in this application. The weight of a body is W=M*g, where W denotes weight, M denotes mass and g denotes acceleration due to gravity. The value of the acceleration g due to gravity on the earth is 9.81 $m/s^2$. The unit of mass M is kg and the unit of weight W (force) is N. A mass M of 1 kg causes a force of 9.81 N on the earth.

The use of the invention is not limited to the elevators disclosed in the figures. The invention can be used in any type of elevator e.g. an elevator comprising a machine room or lacking a machine room, an elevator comprising a counterweight or lacking a counterweight. The counterweight could be positioned on either side wall or on both side walls or on the back wall of the elevator shaft. The drive, the motor, the traction sheave, and the machine brake could be positioned in a machine room or somewhere in the elevator shaft. The car guide rails could be positioned on opposite side walls of the shaft or on a back wall of the shaft in a so called ruck-sack elevator.

The use of the invention is not limited to the weight measuring devises and/or sensors disclosed in the figures. The invention can be used in connection with any kind of weigh measuring device and/or sensor being capable of measuring the total actual axial hanging weight FΣact.

It will be obvious to a person skilled in the art that, as the technology advances, the inventive concept can be implemented in various ways. The invention and its embodiments are not limited to the examples described above but may vary within the scope of the claims.

The invention claimed is:

1. A method for controlling an elevator comprising:

a first step in which the car is on a landing with car doors open for loading and/or unloading the car;

a second step in which it is determined whether the car doors are fully closed or the car doors are not fully open after the loading and/or unloading is completed;

a third step in which the total actual axial mass FΣact hanging from the traction sheave is measured;

a fourth step in which a stalling limit total minimum axial mass FΣmin hanging from the traction sheave is determined;

a fifth step in which reopening of the car doors is checked, whereby if the car doors are reopened, then return to the first step, else, continue to the next step;

a sixth step in which start of the elevator is permitted; and a seventh step in which the total actual axial mass FΣact measured in the third step is compared with the stalling limit total minimum axial mass FΣmin determined in the fourth step, whereby if the total actual axial mass FΣact measured in the third step is equal to or greater than the stalling limit total minimum axial mass FΣmin determined in the fourth step, then normal run of the elevator car to the next landing is permitted, else, the elevator is stopped.

2. The method according to claim 1, wherein the stalling limit total minimum axial mass FΣmin is determined as the sum of the masses F1, F2 acting on both sides of the traction sheave in a situation in which the car is empty.

3. The method according to claim 1, wherein the stalling limit total minimum axial mass FΣmin is determined by deducting from the total actual axial mass FΣact measured in the third step a predetermined stalling weight reduction tolerance (a tolerance weight).

4. The method according to claim 1, wherein the predetermined stalling weight reduction tolerance (the tolerance weight) is determined as the weight KT of the car divided by the suspension ratio SPR of the elevator.

5. The method according to claim 1, wherein when the total actual axial mass (FΣact) is smaller than the determined stalling limit total minimum axial mass (FΣmin) and the elevator is stopped, car stalling is indicated if the mass (F1) on the car side of the traction sheave is zero and counterweight stalling is indicated if the mass (F2) on the counterweight side of the traction sheave is zero.

6. An elevator comprising:

a car;

a shaft;

a hoisting machinery with a traction sheave;

hoisting ropes;

a counterweight;

at least one load sensor device for measuring a total mass (FΣ) acting on a bedplate of the hoisting machinery; and a controller, the hoisting ropes passing over the traction sheave so that the car is suspended with the hoisting ropes on a first side of the traction sheave and the counterweight is suspended with the hoisting ropes on a second opposite side of the traction sheave, the car moving upwards and downwards between landings in the elevator shaft, the controller controlling the elevator based on the method according to claim 1.

7. The elevator according to claim 6, wherein the load sensor is formed of at least one discrete load cell.

8. The elevator according to claim 7, wherein the load sensor is formed of at least one a strain gauge load cell.

9. The elevator according to claim 6, wherein the load sensor is formed of at least one piezoelectric load cell and/or at least one hydraulic load cell and/or at least one pneumatic load cell.

10. The elevator according to claim 6, wherein the load sensor is formed of at least one elastic and stretchable load sensor.

11. The elevator according to claim 6, wherein the at least one load sensor is positioned between a motor frame and a motor bed.

12. The elevator according to claim 11, wherein the at least one load sensor is positioned on a plane surface of a planar vibration isolation pad.

13. The elevator according to claim 11, wherein the at least one load sensor is positioned between the plane surfaces of two vibration isolation pads.

14. A computer program product embodied on a non-transitory computer readable medium and comprising program instructions, which, when run on a computer, causes the computer to perform the method as claimed in claim 1.

15. The method according to claim 2, wherein when the total actual axial mass (FΣact) is smaller than the determined stalling limit total minimum axial mass (FΣmin) and the elevator is stopped, car stalling is indicated if the mass (F1) on the car side of the traction sheave is zero and counterweight stalling is indicated if the mass (F2) on the counterweight side of the traction sheave is zero.

16. The method according to claim 3, wherein when the total actual axial mass (FΣact) is smaller than the determined stalling limit total minimum axial mass (FΣmin) and the elevator is stopped, car stalling is indicated if the mass (F1) on the car side of the traction sheave is zero and counterweight stalling is indicated if the mass (F2) on the counterweight side of the traction sheave is zero.

17. The method according to claim 4, wherein when the total actual axial mass (FΣact) is smaller than the determined stalling limit total minimum axial mass (FΣmin) and the elevator is stopped, car stalling is indicated if the mass (F1) on the car side of the traction sheave is zero and counterweight stalling is indicated if the mass (F2) on the counterweight side of the traction sheave is zero.

18. An elevator comprising:

a car;

a shaft;

a hoisting machinery with a traction sheave;

hoisting ropes;

a counterweight;

at least one load sensor device for measuring a total mass (FΣ) acting on a bedplate of the hoisting machinery; and a controller, the hoisting ropes passing over the traction sheave so that the car is suspended with the hoisting ropes on a first side of the traction sheave and the counterweight is suspended with the hoisting ropes on a second opposite side of the traction sheave, the car moving upwards and downwards between landings in the elevator shaft, the controller controlling the elevator based on the method according to claim 2.

19. An elevator comprising:

a car;

a shaft;

a hoisting machinery with a traction sheave;

hoisting ropes;

a counterweight;

at least one load sensor device for measuring a total mass (FΣ) acting on a bedplate of the hoisting machinery; and a controller, the hoisting ropes passing over the traction sheave so that the car is suspended with the hoisting ropes on a first side of the traction sheave and the counterweight is suspended with the hoisting ropes on a second opposite side of the traction sheave, the car moving upwards and downwards between landings in the elevator shaft, the controller controlling the elevator based on the method according to claim 3.

20. An elevator comprising:

a car;

a shaft;

a hoisting machinery with a traction sheave;

hoisting ropes;

a counterweight;

at least one load sensor device for measuring a total mass (FΣ) acting on a bedplate of the hoisting machinery; and a controller, the hoisting ropes passing over the traction sheave so that the car is suspended with the hoisting ropes on a first side of the traction sheave and the counterweight is suspended with the hoisting ropes on a second opposite side of the traction sheave, the car moving upwards and downwards between landings in the elevator shaft, the controller controlling the elevator based on the method according to claim 4.

* * * * *